US009849943B1

(12) United States Patent
Foster

(10) Patent No.: US 9,849,943 B1
(45) Date of Patent: Dec. 26, 2017

(54) VESSEL BOARDING AND DISEMBARKING APPARATUS

(71) Applicant: The Foster Bar, LLC, Bend, OR (US)

(72) Inventor: Michael S. Foster, Bend, OR (US)

(73) Assignee: The Foster Bar, LLC, Bend, OR (US)

( * ) Notice: Subject to any disclaimer, the term of this patent is extended or adjusted under 35 U.S.C. 154(b) by 0 days.

(21) Appl. No.: 15/297,302

(22) Filed: Oct. 19, 2016

Related U.S. Application Data

(60) Provisional application No. 62/245,304, filed on Oct. 23, 2015.

(51) Int. Cl.
*B63B 17/00* (2006.01)
*B63B 27/14* (2006.01)

(52) U.S. Cl.
CPC ..... *B63B 27/146* (2013.01)

(58) Field of Classification Search
CPC ..... B63B 27/146
See application file for complete search history.

(56) References Cited

U.S. PATENT DOCUMENTS 3,078,955 A * 2/1963 Rich ..... B63B 27/14 182/206
4,502,566 A * 3/1985 Wing ..... E06C 7/484 182/107
7,011,036 B1 * 3/2006 Hill ..... B63B 27/14 114/362
8,356,568 B1 * 1/2013 Chinn ..... B63B 27/146 114/362

* cited by examiner

*Primary Examiner* — Stephen P Avila
(74) *Attorney, Agent, or Firm* — Hancock Hughey LLP

(57) ABSTRACT

A boarding/disembarking apparatus is removably attached to a vessel to assist in boarding and disembarking from the vessel. An upper end of the apparatus engages the vessel's gunwale or transom and the lower end of the apparatus defines a step or platform, and a hull plate rests against the hull. In a first embodiment the hull plate is hinged to conform to the angular hull of the vessel. In a second embodiment the hull brace allows adjustment of the position of the apparatus relative to the boat.

11 Claims, 4 Drawing Sheets

VESSEL BOARDING AND DISEMBARKING APPARATUS

TECHNICAL FIELD

This invention relates to apparatus intended to assist individuals boarding and disembarking from small to medium sized water vessels, and more particularly, is a mechanical device which is easily attached to or detached from a boat's hull to assist in the boarding and disembarking of the boat.

BACKGROUND

Climbing into a boat, and getting out of a boat, can be notoriously difficult, especially when the boat is pulled up to the shoreline and is in shallow water as is often the case with a fishing boat such as a river drift boat, or otherwise when the shore-to-boat junction is less than ideal. Not surprisingly, there are many known devices that are intended to make vessel boarding and disembarking easier. However, most of these devices require either a permanent or hard mounted (to the vessel) attachment point, or a two hook (over the gunwale or transom type) ladder. While such known devices can make boarding and disembarking easier than simply climbing over the gunwale or transom, there are also disadvantages.

For example, with the hard-mounted variety there is only one location for boarding and disembarking—i.e., where the device is mounted to either the hull or transom. This requires that the boat is positioned on the shore such that the hard-mounted device is accessible and adjacent the shore. This is not always possible or convenient depending on the situation. Moreover, permanently or semi-permanently mounting an external device onto a boat is not something that many boat owners want to do. Not only can the device impede performance of the vessel, but the permanent mounts can alter the appearance and functionality of the boat. Another permanent solution that is used on some drift boats is a hinged access doorway that is cut through the hull, typically near the bow. While such a doorway eases access to the boat, the hatch inherently compromises the structural integrity of the hull and may be prone to leaking. And some drift boat owners simply do not like the through-hull doors.

As for the two-hook, over-the-gunwale-or-transom variety, these devices are often cumbersome to use because of the way they hang over the gunwale or transom. Moreover, due to the fact that these ladder-type devices hang on either the gunwale or transom, they tend to create a boarding and disembarking platform that is not entirely stable and which can rock from side to side when a person steps on the rungs of the ladder.

Given the drawbacks of the prior solutions to the problems of getting into and out of a boat, there is always an ongoing need for a device that satisfies boarding and disembarking from multiple locations around the vessel, is simple in form and function, floats, allowing the device to be free from constraints, is easily attached and/or removed from the vessel, is stable at all points of attachment, and does not incorporate permanent mounting fixtures.

The present invention accomplishes all of the foregoing by utilizing a single rigid (over the gunwale or transom) mount, and includes a bracing feature that contacts the hull of the vessel. The increased contact area between the device and the vessel provides stability that is lacking from prior solutions and results in the device inflicting no damage to the vessel.

Although, a single size device according to the present invention is able to satisfy the boarding and disembarking requirements of several types and sizes of vessels, this invention can easily be manufactured in various sizes with varying degrees of adjustability to compensate for the varieties in vessel hull types without losing its unique qualities.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF ILLUSTRATED EMBODIMENTS

The present invention will now be described in detail with reference to the drawings of FIGS. 1 through 5. It will be understood that relative directional terms may be used at times to describe components of the invention and relative positions of the parts. As a naming convention and for the purposes of this description, the plane of the surface of a body of water on which a boat floats is considered herein to be a horizontal and planar surface. Other relative directional terms correspond to this convention: "upper" refers to the direction above and away from the flat surface of the water; "lower" is generally in the opposite direction, "inward" is the direction from the exterior of a boat toward the interior of the boat, with reference for example to FIG. 5, "vertical" is the direction normal to the horizontal plane of a body of water, and so on.

Figure 1:
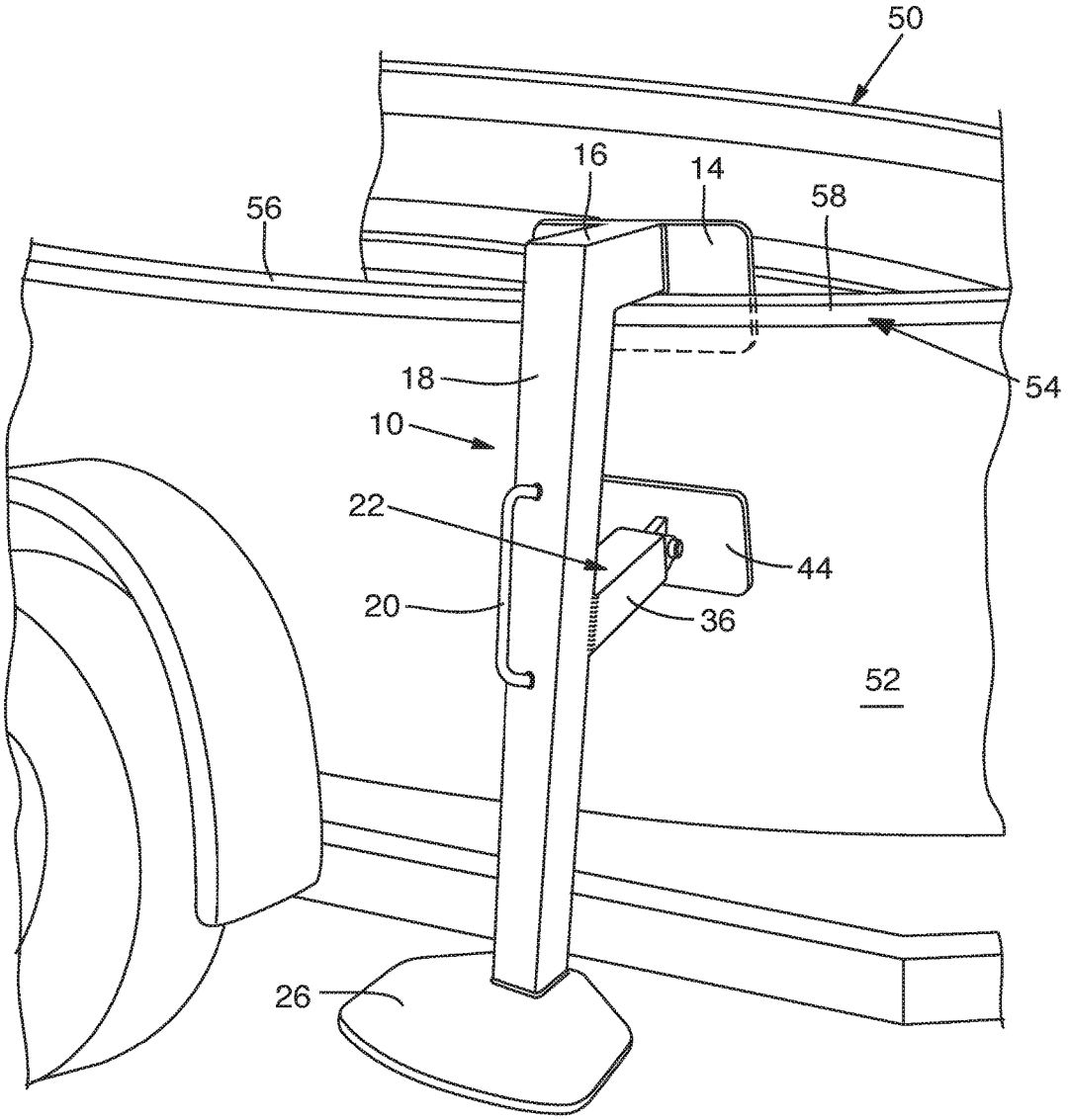
FIG. 1 is a perspective and partial fragmentary view of a first illustrated embodiment of a vessel boarding and disembarkation assist apparatus according to the present invention, mounted on a vessel—in this case a typical river drift boat—and in which the boat is shown on a trailer.
Figure 3:
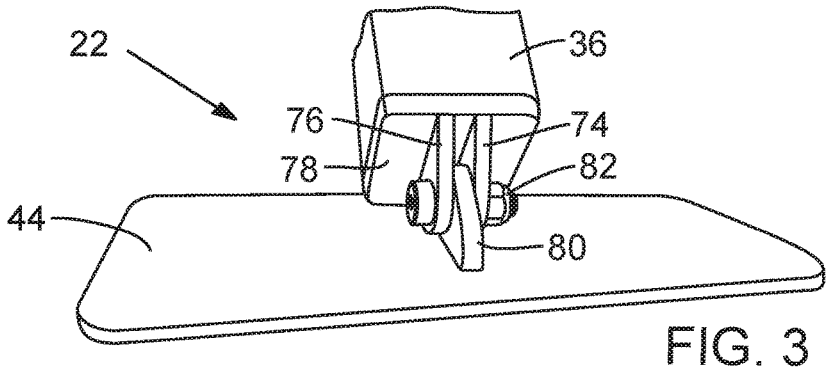
FIG. 3 is a perspective view of a first embodiment of the hull brace portion of the embodiment of the invention shown in FIG. 1.
Figure 2:
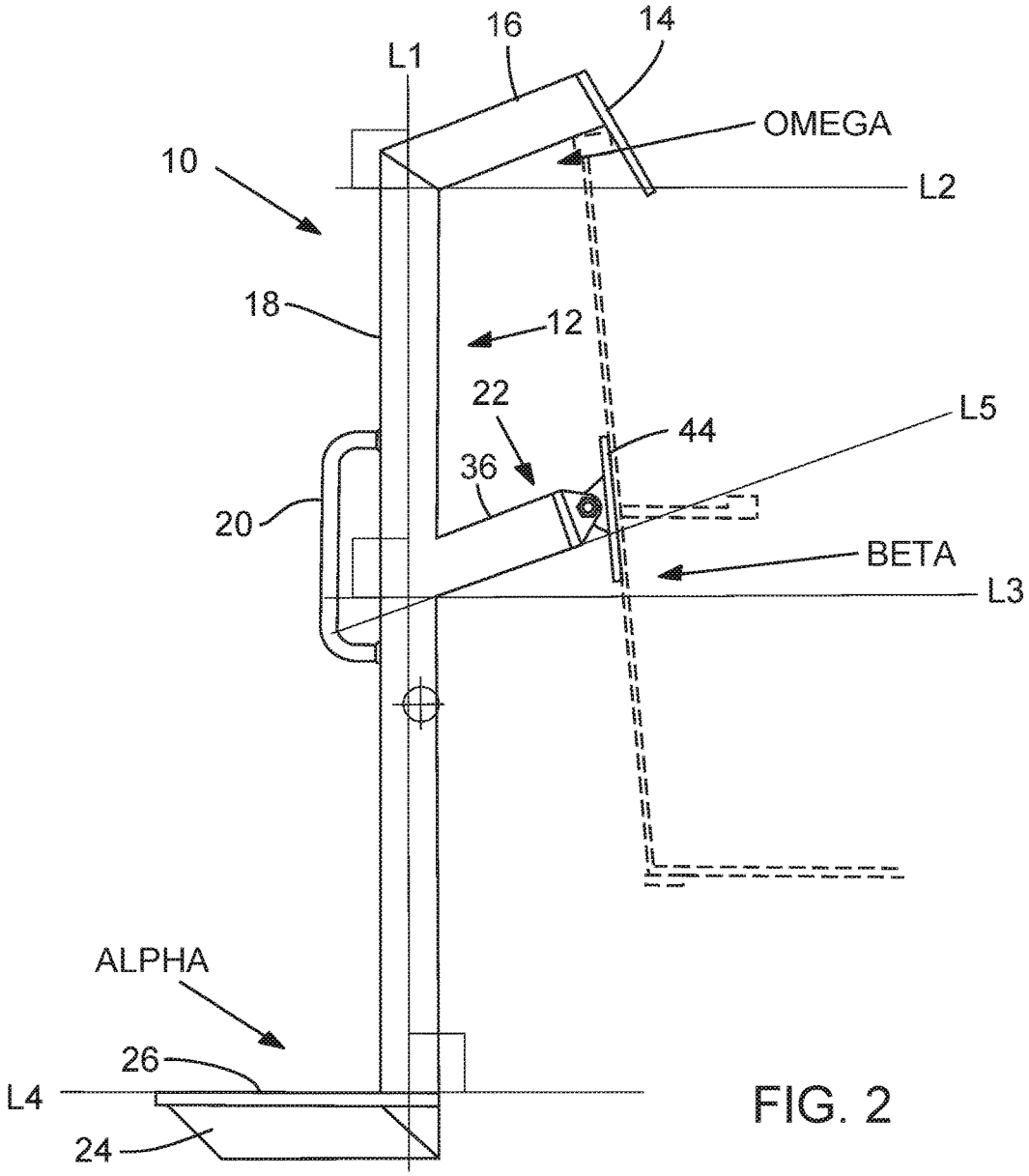
FIG. 2 is a side elevation view of the embodiment illustrated in FIG. 1 in which the apparatus has been mounted on a boat (shown in cross section in phantom lines) and such that the down brace of the vessel boarding apparatus is oriented vertically in the view of the drawing.

A first illustrated and preferred embodiment of the invention is shown in FIGS. 1 through 3.

With reference now to FIGS. 1 and 2, the vessel boarding and disembarking assist apparatus 10 comprises a generally F-shaped member 12 (in side profile as in FIG. 2, or a reversed Z depending upon the side from which the apparatus is being illustrated and the viewer's point of reference). Apparatus 10 comprises a top plate 14 that is connected to a top member or brace 16 such that the top plate 14 is oriented transverse to the top brace. A generally vertically depending down member brace 18 is connected to top brace 16 and preferably but optionally includes a handle 20 along the length of the down brace. ("Vertically depending" refers to the orientation shown in FIGS. 1 and 2.) A hull brace assembly 22 is attached to the down brace 18 approximately midway along the length of the down brace and extends away from the down brace, and when apparatus 10 is mounted on a vessel such as shown in FIG. 1, the hull brace assembly extends toward the vessel. A bottom member or brace 24 (FIG. 2) is connected to the lower end of the down brace 18 and a step 26 is connected to the bottom brace. The components of apparatus 10 just mentioned are preferably strong yet lightweight materials such as aluminum tubing. The components are thus connected to one another by welding. They may alternately be connected with fasteners such as bolts. As noted below, the apparatus is fully sealed so that the entire apparatus floats and is thus easily retrievable in the event the apparatus is dropped into the water.

The apparatus 10 is used with a vessel 50 that includes a hull 52 and a gunwale 54 (or a transom). As may be seen, apparatus 10 is hung on vessel 50 with the top brace top plate 14 extending over the gunwale 54 and with the top brace 16 resting on the upper edge of the gunwale. As detailed below, the hull brace assembly 22 rests on the hull 52 of the vessel and the step 26 is positioned such that a person may step thereon to assist with boarding and unloading. With the top plate 14 hooked over the gunwale 54 and the hull brace assembly 22 bearing against the vessel's hull 52 the apparatus 10 defines a very stable and strong platform for use in boarding and de-boarding the boat 50.

Returning to FIGS. 1 and 2, the construction of apparatus 10 will be detailed. In FIG. 2, apparatus 10 has been oriented on vessel that has a hull that is angled such that the down brace 18 is "vertically" oriented, this to illustrate the preferred relative angular orientation of the various components of the apparatus. It is to be understood that in use the angle of the hull of a vessel relative to the transom varies with the type of boat. As such, and as detailed below, the hull plate 44 that is at the distal end of the brace 36 is hinged to the brace to accommodate all boats. Reference line L1 in FIG. 2 is the vertical and longitudinal axis along down brace 18, and reference lines L2, L3 and L4 are perpendicular to L1 as shown by the right angle symbol at the intersections of these lines. Angle ALPHA is the angular orientation of bottom brace 24 and step 26 relative to L1—that is, the angle between L1 and L4, which as noted is a right angle. Angles BETA and OMEGA are preferably equal. Reference lines L5 and L6 are parallel. Angle BETA is the angle between L3 and L5; angle OMEGA is the angle between L2 and L6; both angles BETA and OMEGA are acute angles.

The relative angular orientations illustrated in FIG. 2 between the components of apparatus 10 are suited to adapt the apparatus for easy use with most vessels 50, which typically have inwardly sloped hulls 52 (inwardly from the gunwale 54 toward the chine 70 at the base of the hull side). In addition, hull brace assembly 22 is adapted to allow apparatus 10 to be used with any vessel. Specifically, hull brace assembly 22 is defined by a hinge 72 that is attached (for example, by welding) to the distal or terminal end of the brace 36 that is attached at its proximate end to down brace 18. With specific reference to FIG. 3 in which the distal portion of hull plate assembly 22 is shown in isolation, hinge 72 is defined by opposed tabs 74 and 76 that are attached to a base plate 78 that is in turn attached to the terminal end of brace 36. A single tab 80 is attached to hull plate 44 and when the hull plate is assembled to the brace a pin or bolt 82 is extended through aligned bores in the tabs 74 and 76 and a bore through tab 80. This construction allows the hull plate to pivot about pin 82 to accommodate a variety of vessels 50 with differently angled hulls.

While the relative angular orientations illustrated are typical for apparatus 10, they may be varied according to factors such as intended use, etc. For example, it will be appreciated that the BETA and OMEGA angles may be varied according to the particular situation. Some vessels have a flat, horizontal gunwale rather than an angled upper surface. Although the apparatus 10 will work fine even with most horizontal gunwales, the OMEGA angle could be changed so that it is a right angle relative to down brace 18.

Figure 4:
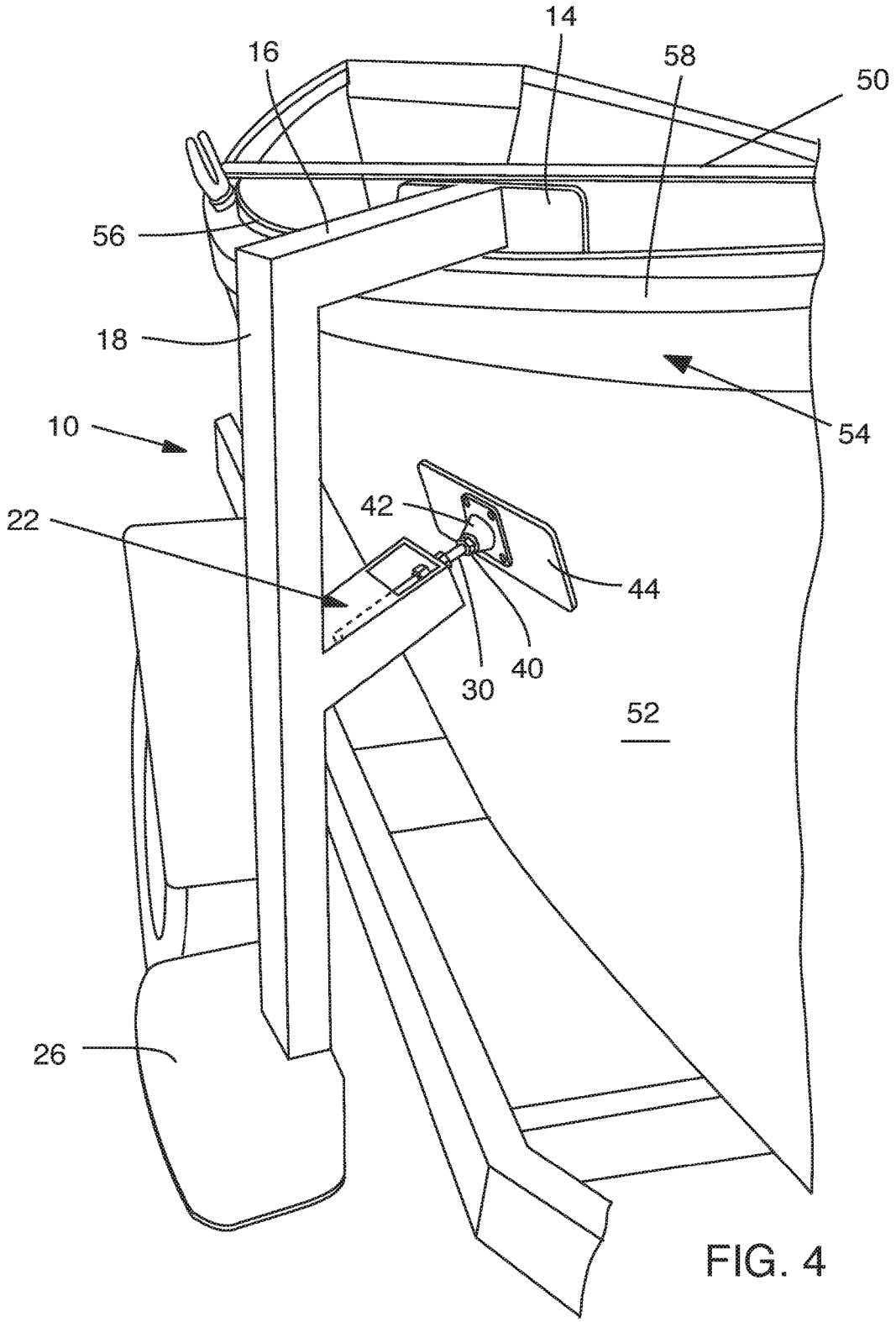
FIG. 4 a perspective and partial fragmentary view of a second illustrated embodiment of a vessel boarding and disembarkation assist apparatus according to the present invention, mounted on a vessel—again, a typical river drift boat—and in which the boat is shown on a trailer.
Figure 5:
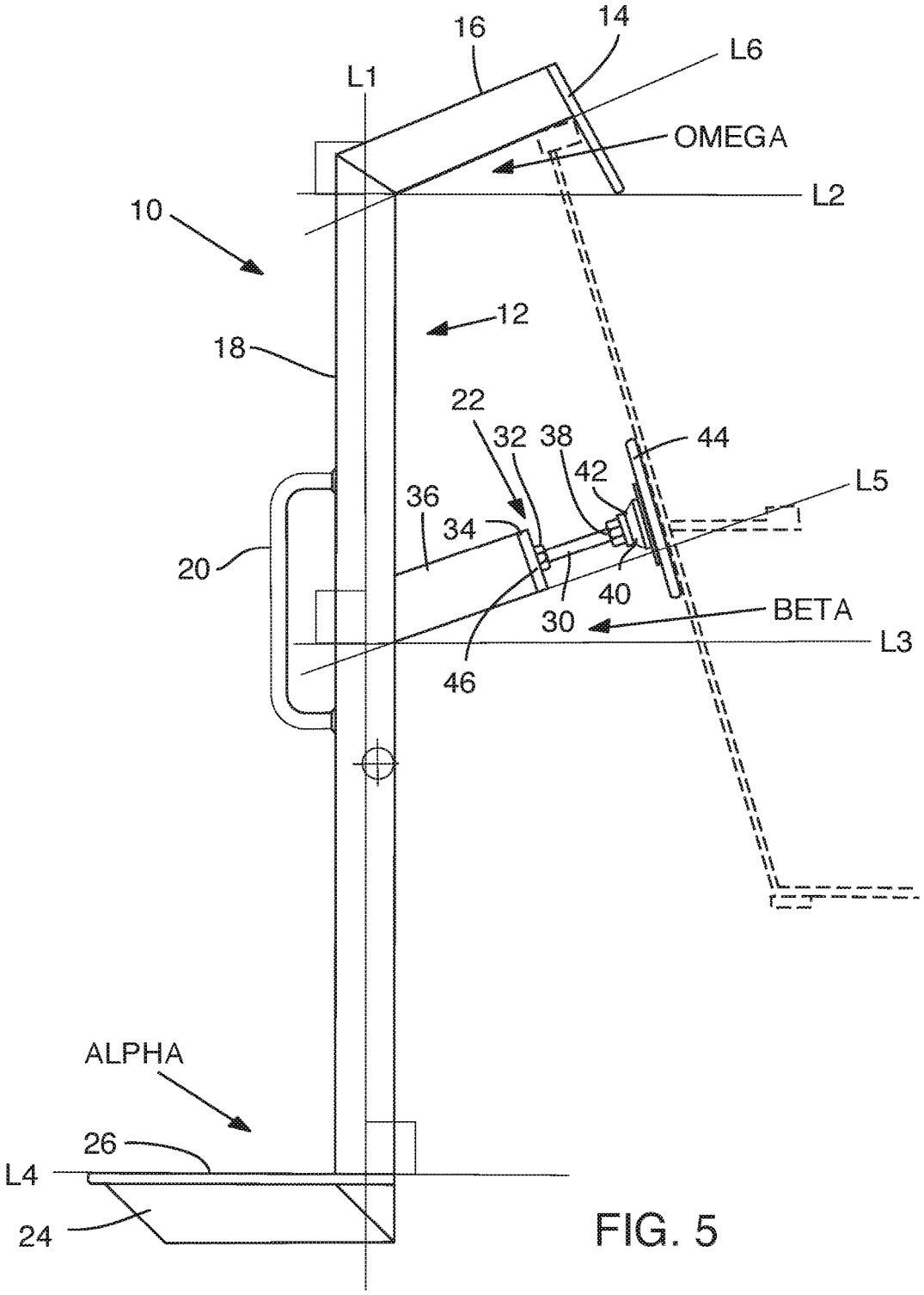
FIG. 5 is a side elevation view of the embodiment illustrated in FIG. 4 in which the apparatus has been mounted on a boat (shown in cross section in phantom lines) and such that the down brace of the vessel boarding apparatus is oriented vertically in the view of the drawing.

An alternative embodiment of a hull assembly 22 is shown in the embodiment of FIGS. 4 and 5. In that embodiment a threaded rod 30 that has its proximate end 32 threaded into a plate 34 that is on the end of brace 36, which is connected to down brace 18. The distal end 38 or rod 30 is defined by a ball and socket joint that allows the hull plate 44 to pivot. Specifically, a ball 40 is received in a socket mount 42 that is connected to the hull plate 44. A lock nut 46 is threaded onto rod 30 so that hull brace assembly 22 is longitudinally adjustable so that the apparatus 10 may be adjustably fitted to a particular vessel 50. And the ball and socket joint allows the hull plate 44 to swivel about ball and socket mount (ball 40, socket mount 42) so that the hull plate rests flush against the hull 52 of the vessel 50.

Use of apparatus 10 will now be described with reference to the all of the drawings. Apparatus 10 is "attached" to boat 50 by hooking the apparatus over the gunwale 54, or the boat's transom as the case may be, such that the 14 extends over the inner edge 56 of the gunwale as shown in the dashed lines in FIG. 1 and so that the top brace 16 rests on the upper edge 58 of the gunwale. When the user releases the apparatus the hull plate 44 makes contact with the hull 52 under the weight of the apparatus 10 and the plate 44 pivots about pin 82 so that it rests flush against the side of the hull. This is best shown in FIG. 2.

When the apparatus 10 is attached to vessel 50 as shown in FIG. 2, step 26 is essentially horizontal. The device is used by a person placing one foot on step 26 and then easily climbing into the boat by swinging their opposite foot into the boat. The apparatus 10 may then be easily removed. A person gets out of the boat in the opposite manner. It will be appreciated that when the weight of a boarding or disembarking person is applied to step 26, a significant rotational moment is created along down brace 18 and so that significant force is applied to hull plate 44, pushing against hull 52. The engagement of top plate 14 on gunwale 52 prevents apparatus 10 from moving during this boarding process, and this pinching or "clamping" moment applied to the gunwale or transom of the vessel, affords a highly stabile platform for step 26 during boarding or disembarking from the vessel 50. Bottom brace 24 creates the necessary structural integrity to mount the step 10 and the step forms the platform utilized while boarding or disembarking the vessel. It can be noted, too, that the apparatus 10 may be utilized when vessel 50 is on a boat trailer (as shown in FIG. 5) to make a convenient step for loading, unloading and cleaning the boat.

The alternate hull plate assembly for apparatus 10 that is shown in FIGS. 4 and 5 is used in much the same manner as described above. The apparatus is "attached" to boat 50 by hooking the apparatus over the gunwale 54 (or the boat's transom as the case may be) such that the 14 extends over the inner edge 56 of the gunwale and so that the top brace 16 rests on the upper edge 58 of the gunwale. The longitudinal length of hull brace assembly 22 is next adjusted so that the down brace 18 is near vertical when the hull plate 44 lies flush against the hull of the vessel 50 on which the device is being used. The length of the hull brace assembly is adjusted by loosening lock nut 46 and rotating threaded rod 30 to thereby extend or retract hull plate 44 from the plate 34. The rod 30 should be rotated until the point when down brace 18 is near vertical when hull plate 44 is resting against hull 52 as seen in FIG. 5. When the length of the hull brace assembly is adjusted to the desired point, lock nut 46 may be tightened against plate 34 to prevent further rotation of rod 30 and thereby securely fix the length of the hull brace assembly 22. Since hull plate 44 may be swiveled on the ball and socket mount, the hull plate adjusts automatically to rest flush against hull 52 as illustrated.

The optional handle 20 allows the user to grasp the apparatus 10 and easily hang it or remove it from a vessel.

It will be appreciated by those of skill in the relevant art that certain modifications may be made to the invention without departing from the scope or spirt of the claims. To articulate a few examples, as noted, the relative angular orientation of the component parts may be varied from the illustrated embodiments. Further, the surface of step 26 may be made slip-resistant by adding adhesive backed sand paper or other similar techniques like abrading the surface, and padding such as foam may be added to the surfaces of apparatus 10 that make contact with boat 50 (for example, the surface of hull plate 44 that makes contact with hull 52, and the surfaces of top plate 14 and top brace 16). If apparatus 10 is specially made for one type of vessel 50, the length of hull brace assembly 44 may be fixed rather than adjustable as shown in the preferred embodiments. Other adaptations may similarly be made, including, making top brace 16 a length-adjustable brace to accommodate boats having different gunwale widths. The size of step 26 may be increased in order to allow for a swimmer to sit on the step, and the step (and/or the top brace) may be hinged to the down brace to facilitate a smaller footprint for storing the apparatus. The apparatus described herein floats without any external floatation. However, external floatation may be added if desired to insure that the apparatus floats in the unfortunate event that it is dropped into the water.

While the present invention has been described in terms of preferred embodiments, it will be appreciated by one of ordinary skill that the spirit and scope of the invention is not limited to those embodiments, but extended to the various modifications and equivalents required for various vessel hull types.

The invention claimed is:

1. Vessel boarding and disembarking apparatus, comprising:

a gunwale engaging member defined by a plate and a top brace connected thereto;

a down brace attached at an upper end thereof to the top brace such that the down brace depends downwardly from the top brace and defines a longitudinal axis, and such that the top brace extends from the down brace from a first side thereof;

a step attached to a lower end of the down brace such that the step extends from the down brace on a second side thereof, wherein the first side is opposite the second side, and wherein the step is attached to the down brace at a right angle relative to the longitudinal axis; and a hull plate assembly attached to the down brace on the first side thereof, the hull plate assembly including a hull plate that is attached to the distal end of a rod with a ball and socket attachment.

2. The apparatus according to claim 1 in which the hull plate assembly further comprises a hull plate brace attached to the down brace.

3. The apparatus according to claim 2 in which the hull plate is movable relative to the hull plate brace.

4. The apparatus according to claim 1 in which the rod is threaded through a bracket on a terminal end of the hull plate brace.

5. The apparatus according to claim 1 in which the top brace and the hull plate brace are attached to the down brace at an acute angle relative to the longitudinal axis.

6. The apparatus according to claim 4 in which the hull plate is extendable relative to the hull plate brace.

7. Vessel boarding and disembarking apparatus for use with a vessel having a hull, comprising:

a gunwale engaging member defined by a top brace and a gunwale plate connected thereto and extending transverse to a longitudinal axis of the top brace;

a down brace attached to the top brace such that the down brace depends downwardly from the top brace and such that the top brace extends from the down brace from a first side thereof, the down brace having a longitudinal axis;

a hull plate brace attached to the down brace and a hull plate attached to the hull plate brace, the hull plate attached to the distal end of a rod with a ball and socket attachment and defining a planar surface that has a major plane that is parallel to the hull of the vessel; and a step attached to a lower end of the down brace at a right angle relative to the longitudinal axis and such that the step extends from the down brace on a second side thereof, wherein the first side is opposite the second side.

8. The apparatus according to claim 7 in which the rod is threaded through a bracket on a terminal end of the hull plate brace.

9. The apparatus according to claim 8 in which the hull plate is extendable relative to the hull plate brace.

10. Vessel boarding and disembarking apparatus for use with a vessel having a hull, comprising:

a gunwale plate attached to a distal end of a top brace and defining a hook adapted for engaging a gunwale of the vessel, wherein the top brace defines a first longitudinal axis;

a down brace attached to the top brace and depending downwardly from the top brace, the down brace defining a second longitudinal axis, wherein the top brace extends from the down brace in a first direction and the first longitudinal axis is at a first angle relative to the second longitudinal axis;

a hull support means attached to the down brace for abutting the hull, the hull support means further comprising a hull plate brace attached to the down brace and wherein the hull plate brace defines a longitudinal axis that is parallel to the first longitudinal axis, and wherein a hull plate is attached at a ball and socket joint to a terminal end of a threaded rod that extends through a threaded opening in a base plate at the terminal end of the hull plate brace; and a step attached to the down brace and the step extends from the down brace in a second direction that is opposite the first direction and at a right angle relative to the second longitudinal axis.

11. The apparatus according to claim 10 in which the hull support means further comprises a hull plate brace attached to the down brace and a hull plate attached to a terminal end of the hull plate brace, wherein the hull plate brace defines a longitudinal axis that is parallel to the first longitudinal axis and the hull plate defines a planar surface that has a major plane that is parallel to the hull of the vessel and in which the hull plate is attached to the hull plate brace at a hinged connection so that the hull plate is pivotal about a hinge axis that is normal to the second longitudinal axis.

* * * * *